US006688862B2

(12) United States Patent
Jeronymo et al.

(10) Patent No.: US 6,688,862 B2
(45) Date of Patent: Feb. 10, 2004

(54) CONSTANT FLOW VANE PUMP

(75) Inventors: Carlos Jeronymo, Toronto (CA); Jaroslaw Lutoslawski, Scarborough (CA)

(73) Assignee: Tesma International Inc., Concord (CA)

( * ) Notice: Subject to any disclaimer, the term of this patent is extended or adjusted under 35 U.S.C. 154(b) by 0 days.

(21) Appl. No.: 10/049,561

(22) PCT Filed: Jun. 29, 2001

(86) PCT No.: PCT/CA01/00943

§ 371 (c)(1),
(2), (4) Date: Jul. 8, 2002

(87) PCT Pub. No.: WO02/01073

PCT Pub. Date: Jan. 3, 2002

(65) Prior Publication Data

US 2002/0172610 A1 Nov. 21, 2002

Related U.S. Application Data

(60) Provisional application No. 60/215,042, filed on Jun. 29, 2000.

(51) Int. Cl.[7] ..... F04C 15/04
(52) U.S. Cl. ..... 418/26; 418/27; 418/30
(58) Field of Search ..... 418/30, 26, 27

(56) References Cited

U.S. PATENT DOCUMENTS

| | | | | | |
|---|---|---|---|---|---|
| 3,381,622 A | | 5/1968 | Wilcox | | |
| 3,642,388 A | | 2/1972 | Maistrelli | | |
| 4,342,545 A | * | 8/1982 | Schuster | ..... | 418/26 |
| 4,679,995 A | | 7/1987 | Bristow | | |

FOREIGN PATENT DOCUMENTS

| | | | | | |
|---|---|---|---|---|---|
| GB | 2232208 A | * | 12/1990 | ..... | F04C/15/00 |
| JP | 57062986 A | * | 4/1982 | ..... | F04C/2/344 |
| JP | 59058186 A | * | 4/1984 | ..... | F04C/15/02 |

* cited by examiner

*Primary Examiner*—Thomas Denion
*Assistant Examiner*—Theresa Trieu
(74) *Attorney, Agent, or Firm*—Clark Hill PLC

(57) ABSTRACT

A variable capacity pump includes a housing and a rotatable rotor within the housing. The rotor includes radial slots to accommodate slidable vanes or rotor blades, wherein the vanes are urged outwards by centrifugal force into contact with the inner surface of a surrounding cam ring. The cam ring is surrounded on one end by a pressure chamber including a piston under hydraulic pressure, and on the other end by a seated spring. By controlling the pressure distributed to the pressure chamber, the position of the cam ring with respect to the rotor may be changed to automatically vary the displacement of the pump in response to a pressure differential across a restriction orifice, thereby regulating the output flow to be constant over a defined speed range.

4 Claims, 2 Drawing Sheets

CONSTANT FLOW VANE PUMP

This application is the U.S. national stage of PCT/CA01/00943, filed Jun. 29, 2001, which claims the benefit of U.S. provisional application Ser. No. 60/215,042, filed June 29, 2000.

TECHNICAL FIELD

The subject invention relates generally to a variable capacity pump and, more particularly, to a variable capacity vane pump for delivering a constant flow output under variable pressure conditions.

BACKGROUND OF THE INVENTION

Many industrial and automotive devices require a continuous supply of compressible fluid such as oil and fuel to operate. In order to obtain a given fluid output, a pump may be driven at a constant speed by means of an electric motor or, as more commonly found in automobiles, by utilizing the engine rotation to drive a pump shaft via a belt connection between a driving pulley (connected to the crankshaft of the engine) and a driven pulley. However, it is often desirable to maintain a constant fluid output irrespective of the engine speed. To meet this need, the following two types of pumps are commonly used:

1. A variable-capacity pump capable of delivering a sufficient fluid output even when the engine operates at a minimum speed. When the engine speed is increased, the capacity of the pump is proportionally reduced to keep the fluid output at a substantially constant value;
2. A constant-capacity pump designed for delivering the specified fluid output when the engine operates at a minimum speed. When the engine speed is increased, an increasing fraction of the pump output is diverted and returned to the reservoir (or the suction port of the pump) to maintain the fluid output at a constant value.

Variable capacity pumps are favored in that they offer a significant improvement in energy efficiency and can respond to changes in operating conditions more quickly than constant-capacity pumps. For example, automatic and continuously variable transmissions require oil pressures approaching 1200 psi. If a constant-capacity pump is used in this application, power consumption increases dramatically at higher engine speeds, such as those experienced under normal highway driving conditions, because the flow amount is directly proportional to engine speed. A pressure compensated pump also suffers from the problem of long response times when a clutch or hydraulic device is actuated.

U.S. Pat. No. 3,381,622 discloses a variable output roller pump with a constant output pressure. The pump comprises a mounting plate, a cavity body mounted to the mounting plate, a cam ring enclosed within the cavity body, and a rotor mounted about a fixed axis within the cam ring. The rotor includes a number of radial slots for retaining rollers. The mounting plate includes fluid inlet and outlet ports aligned with the root circle of the roller slots for respectively delivering and removing fluid to and from each slot as the rotor rotates. The pump also includes a leaf spring and a pressure conduit coupled between the cam ring and the leaf spring for reducing the eccentricity of the cam ring (and hence the output pressure) as the output pressure increases.

U.S. Pat. No. 3,642,388 discloses a variable output roller pump with a continuously variable output flow. The pump comprises a housing in which a rotor is rotatably mounted about a fixed axis within a surrounding cam ring. The rotor has a series of radial angularly spaced notches in which rollers are slidably mounted. The cam ring is rotatably coupled to a roller at one end and to a hydraulically operated piston at the opposite end for urging the cam ring between a maximum and minimum pump flow position in response to changes in hydraulic fluid pressure acting on the piston.

U.S. Pat. No. 4,679,995 proposes a variable capacity rotary pump similar to U.S. Pat. No. 3,381,622, except that the cam ring pivots about a roller at one end and is urged into a position of maximum fluid output by a spring seated at the opposite end. At the same time, a portion of pressurized fluid output exerts a force to counteract the spring force so as to automatically reduce the flow output of the pump when the output pressure increases.

In each prior art example, differences in the fluid pressures of the fluid chamber entering the outlet port and the fluid chamber exiting the outlet port can cause undesirable variations in the output pressure of the pump. Accordingly, there remains a need for a variable capacity pump that provides a constant fluid flow under variable output pressures.

SUMMARY OF THE INVENTION

The present invention provides an oil pump construction with its capacity variable in order to keep the pump flow constant and independent of engine speed or line pressure.

The variable capacity pump comprises a housing, a rotatable rotor within the housing. The rotor includes radial slots to accommodate slidable vanes or rotor blades, wherein the vanes are urged outwards by centrifugal force into contact with the inner surface of the surrounding cam ring. The cam ring is surrounded on one end by a pressure chamber and on the other end by a seated spring.

A venturi tube is preferably employed to obtain the differential pressure necessary to measure the flow being delivered by the pump and to give a feedback signal to a hydraulic control valve to adjust the pump capacity.

The control valve may be a spool valve. The spool valve is biased to a rest position and operates to connect the pressure chamber to either a discharge port or a high pressure output line whenever the pressure differential of the main output across a venturi tube exceeds a predetermined value. By controlling the pressure distributed to the pressure chamber, the position of the cam ring with respect to the rotor may be changed to automatically vary the displacement of the pump.

In another embodiment the control valve is eliminated, and a pivot pin defines two control volumes acting on either side of the cam ring. Differential fluid pressure acting on these control volumes controls the cam ring position or eccentricity directly.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE PREFERRED EMBODIMENTS

Figure 1:
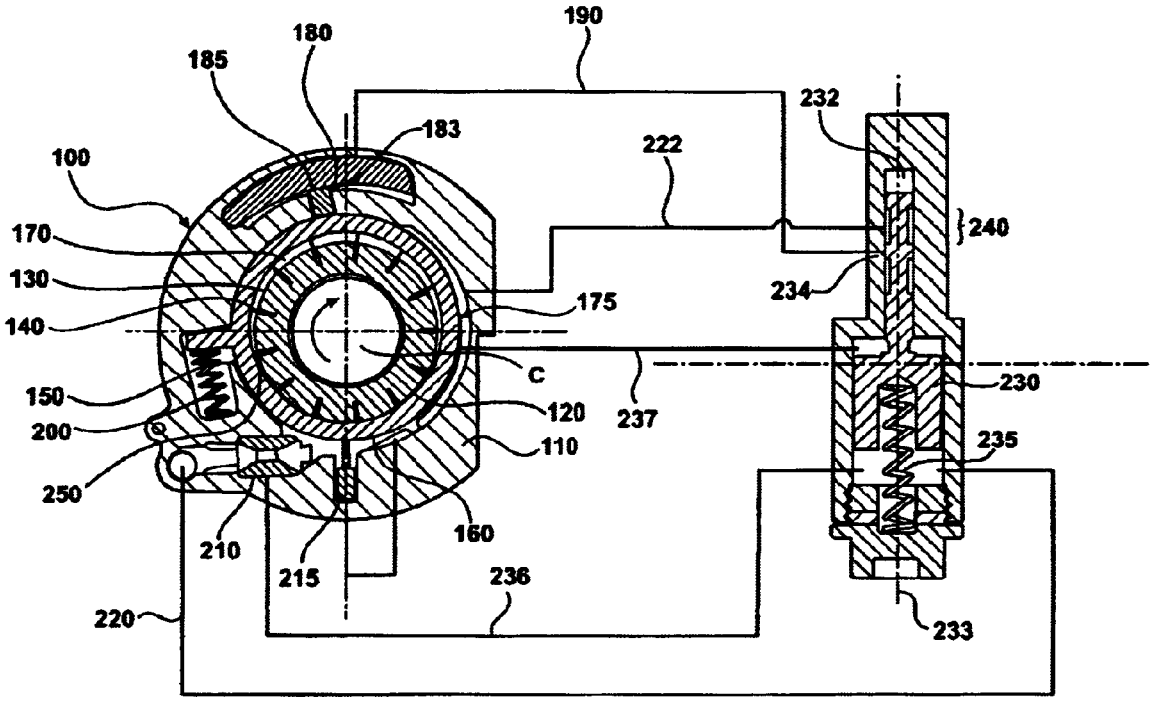
FIG. 1 is a cross-sectional view of a positive displacement pump of variable, capacity according to the present invention.

FIG. 1 shows an embodiment of variable displacement pump 100 comprises a housing 110 in which a substantially cylindrical rotor 120 is mounted about the central axis C of the housing 110. The rotor 120 comprises a series of radial, angularly spaced notches 130 in which vanes 140 are slidably mounted. The vanes 140 form in conjunction with the inner surface 150 of the surrounding cam ring 160 as many pumping chambers 170. The volume of the pump chambers 170' varies with rotation of the rotor 120, which forms a suction section in the volume increasing portion and a discharge section in the volume decreasing portion.

The position of the cam ring 160 is effected by a compression spring 200 or other biasing member and by a hydraulically actuated piston 215. The spring 200 and hydraulic forces of the piston 215 bias the cam ring 160 in the direction where the volumetric displacement of the pump is maximized. A lever arm 185 has one side connected to a pressure line 190 and the other side to a drain port (not shown). When pressurized fluid from pressure line 190 enters a chamber 180, the lever arm 185 moves and presses a piston 183 against the cam ring 160, reducing the eccentricity of the pump 100 and, consequently, its volumetric displacement. When the pressure line 190 is connected to the drain port, the pressure in chamber 180 is released and the cam ring 160 moves back to the position of maximum eccentricity. Oil discharges from the pump through holes (not shown) in the cam ring 160 and cuts in the sideplates. Oil fills up the cavity around the outer diameter of the cam ring 160 and discharges through an outlet port 220. By way of comparison, a conventional pump would require an oil passage under the pressure port of the rotor, so the proposed configuration is very compact, permitting the installation of the pump in transmissions with minimal axial space.

The pump 100 operates in the following manner. As the rotor 120 rotates, the volume of each pumping chamber 170 varies in order to produce the necessary pumping action. The magnitude of the eccentricity of cam ring 160 in relation to rotor 120 controls the change of volume in the chambers 170 and, therefore, the pump capacity. The forces urging the cam ring 160 against the rotor 120 are produced by the pressure of the compression spring 200, the pressure from the outlet port 220 and hydraulic pressure exerted on the lever arm 185. The hydraulic piston 215 is optional. The angular relationship of the outlet port 220 in relation to the pivot point 175 of the cam ring 160 ensures that the forces exerted by the lever arm 185 are balanced to maintain adequate control at higher line pressures.

During operation, the pump output flows past a venturi tube or orifice 210, causing a small pressure drop in the main output pressure port 220. This pressure drop is directly proportional to the flow, so that when the flow increases, the pressure drop also increases. The outlet line 222 with higher pressure is connected to one side of a control valve 230 and an outlet line 236 from the venturi tube 210 with lower pressure is connected to the opposite side of the control valve 230. The control valve 230 includes a spring or other biasing member 235. The pressure control line 190 extending from the pressure chamber 180 is connected to the control valve 230 at connection point 234. A discharge port 240 is located on the opposite face of the control valve 230.

In the embodiment shown in FIG. 1, the control valve 230 is a spool valve with two different cross-sectional areas. The first cross-sectional area is relatively large in order to create the necessary hydraulic force to axially move the spool valve 230 against the force of the spring 235 without requiring a large pressure drop in the venturi tube 210. The direction of movement depends on the differential pressure created by the venturi 210. Conversely, the second cross-sectional area is smaller to reduce the leakage path of the valve 230 and to increase the efficiency of the control system.

If the flow being delivered by the pump becomes lower than the desired or predetermined output, the pressure drop across the venturi orifice 210 will decrease, and the control valve 230 will subsequently move toward one end 232 due to the biasing effect of the spring 235 located on the opposite end 233. The control pressure line 190 will then be connected to the discharge port 240, thereby depressurizing the pressure chamber 180. The force of the main spring 200 will then move the cam ring 160 away from its nested position, thereby increasing the eccentricity of the cam ring 160 in relation to rotor 120 and increasing the flow rate.

When the flow being delivered by the pump becomes higher than the desired or predetermined output, the pressure drop across the orifice 210 will increase, and the control valve 230 will move subsequently toward the opposite end 233 against the biasing spring 235. The control pressure line 190 will then be disconnected from the discharge port 240 and connected to a high pressure line 222, thereby pressurizing the pressure chamber 180. This hydraulic force acting on the lever arm 185 will at least partially overcome the force of the main spring 200 and hydraulic piston 215 and move the cam ring 160 so that the eccentricity is reduced, resulting in a lower pump flow.

Figure 2:
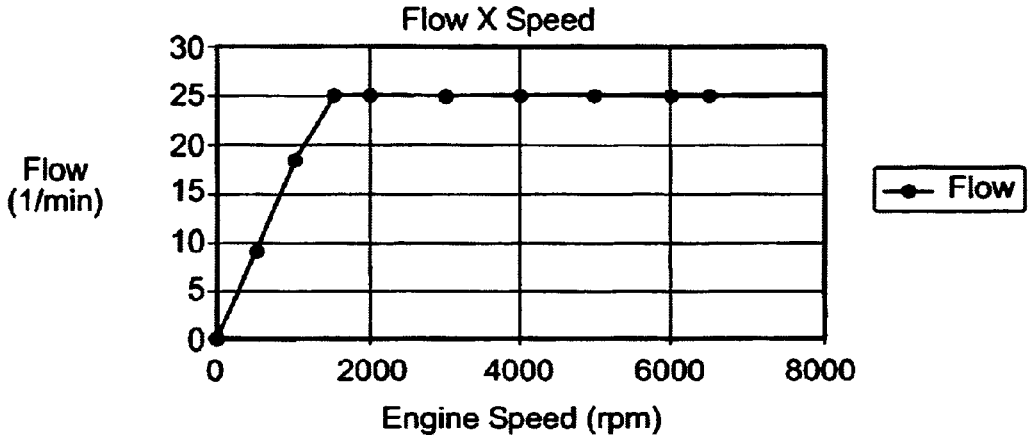
FIG. 2 is a characteristic view showing the relation between flow output and engine speed during experimental trials on a prototype pump constructed according to the disclosed invention.

Experimental test results performed on a prototype variable displacement vane pump described herein are shown in FIG. 2. For operating temperatures below 100° C., the prototype pump delivered a constant flow of oil that was essentially independent of engine speeds in excess of 1750 rpm.

Figure 3:
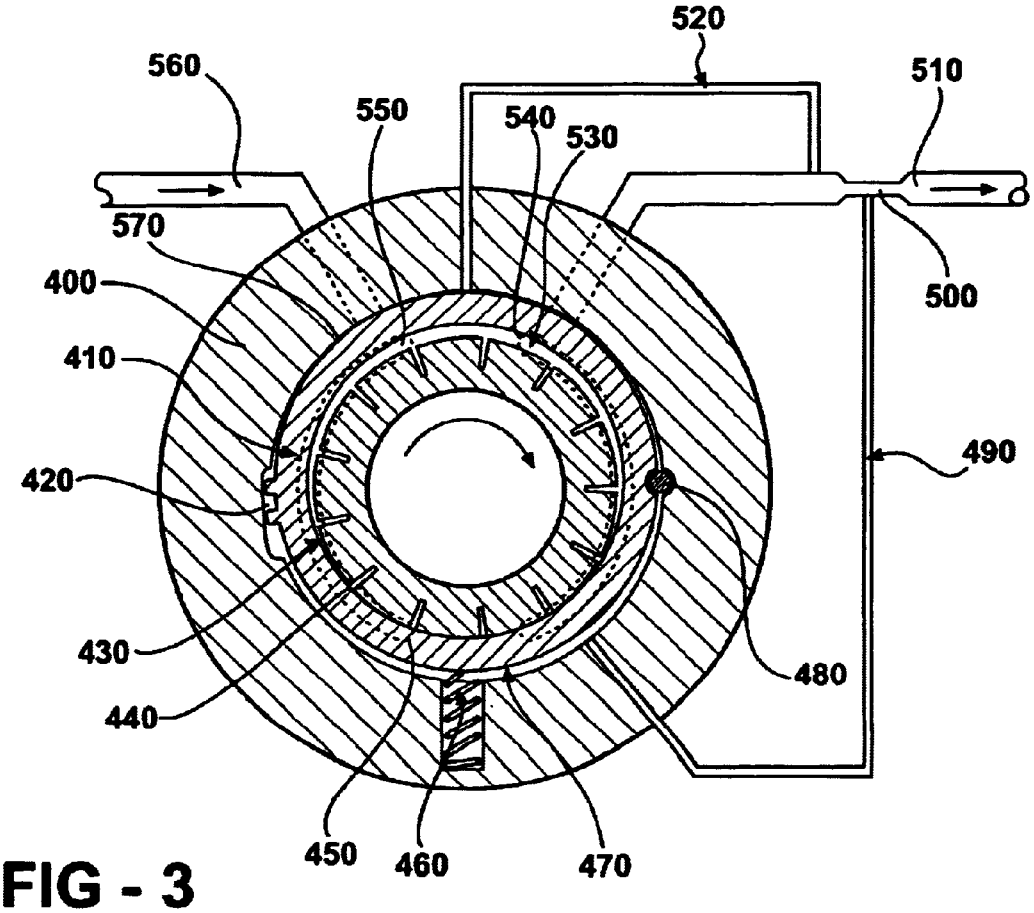
FIG. 3 is a cross-sectional view of a positive displacement pump of variable capacity according to a second embodiment of the present invention.

Referring to FIG. 3, there is shown another modified form of the variable displacement pump of the invention. In this embodiment, the lever arm and separate spool valve are eliminated, and differential fluid pressure acting on the outside of the cam ring 410 controls the cam ring position or eccentricity. The differential pressure is achieved by the pressure drop developed in the orifice 500 in the main outlet line 510 down stream of the outlet port 530.

Line pressure acts on one side of the cam ring 410 and the lower pressure from orifice 500 acts on the opposite side. The orifice pressure is directed into cavity or first control volume 470 by line 490. The first control volume 470 is a sealed volume defined by the cam ring seal 420, the ram ring 410, the pump housing 400, and a pivot pin 480. A second control volume 570 is another sealed volume defined by the cam ring seal 420, the cam ring 410, the pump housing 400, and the pivot pin 480. The higher line pressure in the second control volume 570 will urge the cam ring 410 against the opposing venturi pressure in the first control volume 470 and the force from spring 460. The resultant force on the cam ring 410 from the pressure in the second control volume 570 or the first control volume 470 is directly proportional to the projected area the control volume has on the cam ring 410. Therefore, the position of the cam ring seal 420 relative to the pivot point 480 influences the force multiplication from the differential pressure between the output and orifice. With this design, the flow of the pump is limited and controlled regardless of output pressure.

Although this invention has been described in conjunction with specific embodiments, many modifications and variations will be apparent to those skilled in the art. For example, instead of the cam ring 410 pivoting about a pin 480, the cam ring can also slide up and down inside a suitably modified housing 400.

What is claimed is:

1. A variable capacity displacement pump comprising: a pump housing; a rotor rotatably mounted in said housing; a cam ring surrounding said rotor in said housing for pumping fluid through said housing between an inlet and an outlet fluid port; at least one pumping chamber defined between said cam ring and said rotor for transferring fluid between said inlet and outlet ports; a pivot connection between said cam ring and said housing for providing movement of said cam ring within said housing independent of said rotor for varying the eccentricity of said rotor with respect to said cam ring, said pivot connection including a pivot pin interconnecting said cam ring and said housing, a projection seated in an opening in said housing opposite said pivot pin, and a biasing member compressed between said housing and said projection for biasing said cam ring in a predetermined position; a first pressure chamber formed between the outer periphery of said cam ring and said housing; a piston operatively coupled to said housing for acting on the outer periphery of said cam ring; a biasing member operatively coupled to said housing opposite said piston for counteracting on the outer periphery of said cam ring; a flow regulating control valve having a first end in fluid communication with said housing adjacent said piston and a second end in fluid communication with said outlet port for controlling the eccentricity of said cam ring relative to said rotor and the fluid flow from said outlet port in response to varying rotational speeds of said rotor; a pressure sensing mechanism coupled between said pumping chamber and said outlet port for determining the fluid flow of said pump through said output port, said pressure sensing mechanism is a venturi tube coupled in fluid communication between said first pressure chamber and said outlet port; and said housing includes a second pressure chamber for pivotally housing a lever arm therein, said piston seated between said lever arm and said cam ring for moving and changing the eccentricity of said cam ring in response to pivotal movement of said lever arm, wherein said first end of said control valve is in fluid communication with said second pressure chamber for controlling said pivotal movement of said lever arm.

2. A variable capacity pump as set forth in claim 1 wherein said control valve is a spool valve.

3. A variable capacity pump as set forth in claim 1 wherein said rotor includes a plurality of radially projecting and angularly spaced apart notches for slidably supporting respective vanes seated between said rotor and the inner periphery of said cam ring.

4. A variable capacity pump as set forth in claim 3 further including a pumping chamber defined between said inner periphery of said cam ring, the outer periphery of said rotor and between each adjacent spaced apart pair of vanes.

* * * * *